US009771180B2

(12) United States Patent
Iwashita

(10) Patent No.: US 9,771,180 B2
(45) Date of Patent: Sep. 26, 2017

(54) ADJUSTABLE HANDLE FOR ATTACHMENT TO A PLASTIC BOTTLE

(71) Applicant: The Coca-Cola Company, Atlanta, GA (US)

(72) Inventor: Hiromasa Iwashita, Tokyo (JP)

(73) Assignee: THE COCA-COLA COMPANY, Atlanta, GA (US)

( * ) Notice: Subject to any disclaimer, the term of this patent is extended or adjusted under 35 U.S.C. 154(b) by 672 days.

(21) Appl. No.: 13/746,370

(22) Filed: Jan. 22, 2013

(65) Prior Publication Data

US 2013/0186849 A1 Jul. 25, 2013

(30) Foreign Application Priority Data

Jan. 19, 2012 (JP) ..... 2012-009259

(51) Int. Cl.
*B65D 23/00* (2006.01)
*B65D 23/10* (2006.01)

(52) U.S. Cl.
CPC ..... *B65D 23/10* (2013.01); *B65D 23/106* (2013.01)

(58) Field of Classification Search
CPC ..... B65D 23/01; B65D 23/106
USPC ..... 215/396, 399; 220/318, 710.5, 758, 759, 220/769; 294/31.2; D7/622–623
See application file for complete search history.

(56) References Cited

U.S. PATENT DOCUMENTS 395,504 A * 1/1889 Nason ..... 248/141
622,862 A * 4/1899 Pierce ..... 294/31.2
1,464,789 A * 8/1923 Ward ..... 215/226
1,825,897 A * 10/1931 Brooke ..... 294/31.2
D88,100 S * 10/1932 Lehman ..... D7/622
D91,786 S * 3/1934 Panza ..... D7/622
2,075,217 A * 3/1937 Milburn ..... 215/395
2,088,387 A * 7/1937 Rice, Jr. et al. ..... 215/395
D149,933 S * 6/1948 Bushman ..... D7/622
D154,921 S * 8/1949 Haffner ..... D7/399
(Continued)

FOREIGN PATENT DOCUMENTS

DE 20318107 U1 4/2004
DE 10310281 A1 8/2004
(Continued)

OTHER PUBLICATIONS

European Search Report for EP Application No. 13152091.8 dated Apr. 5, 2013.

*Primary Examiner* — Anthony Stashick
*Assistant Examiner* — Ernesto Grano
(74) *Attorney, Agent, or Firm* — Eversheds Sutherland (US) LLP

(57) ABSTRACT

A handle may be provided with a neck supporting part that mates with the neck of the bottle, a bottom supporting part that receives the bottom of a bottle and supports the bottom of the bottle, and a gripping part that connects the bottom supporting part and the neck supporting part. The neck supporting part may have a first engagement part and a second engagement part with which the neck may engage and disengage. The gripping part extends in a substantially vertical direction along the body of the bottle when the neck is engaged with the first engagement part and extends in a substantially slanted direction relative to the substantially vertical direction so as to draw apart from the bottle when the neck is engaged with the second engagement part.

14 Claims, 10 Drawing Sheets

(56) References Cited

U.S. PATENT DOCUMENTS

| | | | | | |
|---|---|---|---|---|---|
| D171,008 | S | * | 12/1953 | Peterson | D7/622 |
| D186,555 | S | * | 11/1959 | Hunt | D7/622 |
| 2,928,570 | A | * | 3/1960 | Fitch | 220/742 |
| 3,202,309 | A | * | 8/1965 | Simpson | 215/395 |
| D209,533 | S | * | 12/1967 | Cole | D7/622 |
| D211,818 | S | * | 7/1968 | Massey | D7/622 |
| 3,427,064 | A | * | 2/1969 | Hanschar | 294/32 |
| 3,458,164 | A | * | 7/1969 | Massey | 248/145.6 |
| D225,435 | S | * | 12/1972 | Anthony | D7/622 |
| D225,437 | S | * | 12/1972 | Killigrew, Jr. | D7/622 |
| 3,979,011 | A | * | 9/1976 | Schleicher | 220/742 |
| RE29,708 | E | * | 7/1978 | Schlegel | 222/465.1 |
| D256,418 | S | * | 8/1980 | Corbett | D7/622 |
| D265,159 | S | * | 6/1982 | La Barbera | D7/622 |
| D265,880 | S | * | 8/1982 | Craig | D7/622 |
| 4,379,578 | A | * | 4/1983 | Schuler | 294/31.2 |
| 4,486,043 | A | * | 12/1984 | Rais | 294/27.1 |
| 4,511,167 | A | * | 4/1985 | Kawaguchi | 294/28 |
| 4,552,396 | A | | 11/1985 | Rais et al. | |
| 4,660,876 | A | * | 4/1987 | Weldin et al. | 294/33 |
| 4,666,197 | A | * | 5/1987 | Watson et al. | 294/31.2 |
| 4,667,359 | A | * | 5/1987 | Polotti | 7/151 |
| D292,160 | S | * | 10/1987 | Thomas | D7/622 |
| 4,724,971 | A | * | 2/1988 | Henline | 215/396 |
| D298,200 | S | * | 10/1988 | Block et al. | D7/622 |
| 4,896,913 | A | * | 1/1990 | Kennedy | 294/31.2 |
| D309,072 | S | * | 7/1990 | Golkar | D7/622 |
| 4,982,869 | A | * | 1/1991 | Robbins, III | 220/742 |
| 5,025,940 | A | | 6/1991 | Akly et al. | |
| 5,176,280 | A | * | 1/1993 | Robbins, III | 220/737 |
| 5,183,169 | A | | 2/1993 | Grzych et al. | |
| D343,094 | S | * | 1/1994 | Varney | D7/622 |
| D357,387 | S | * | 4/1995 | Davidson et al. | D7/622 |
| 5,413,231 | A | | 5/1995 | Carroll et al. | |
| D359,657 | S | * | 6/1995 | Davidson et al. | D7/622 |
| D369,724 | S | * | 5/1996 | Wieneke | D7/622 |
| D405,321 | S | * | 2/1999 | Martorana | D7/622 |
| D440,496 | S | * | 4/2001 | Adam et al. | D7/622 |
| 6,543,825 | B1 | * | 4/2003 | Dragutin | 294/31.2 |
| D478,509 | S | * | 8/2003 | DeCotis | D9/455 |
| 6,651,838 | B2 | * | 11/2003 | Bissell | 220/741 |
| D494,471 | S | * | 8/2004 | Chou | D9/455 |
| D505,328 | S | * | 5/2005 | Chou | D9/455 |
| D512,275 | S | * | 12/2005 | Kent-Fawkes | D7/622 |
| 6,979,031 | B2 | * | 12/2005 | Coppotelli et al. | 294/27.1 |
| D524,607 | S | * | 7/2006 | Kent-Fawkes | D7/622 |
| D557,567 | S | * | 12/2007 | Gronikowski et al. | D7/622 |
| D593,859 | S | * | 6/2009 | Barnum | D9/455 |
| D609,534 | S | * | 2/2010 | Traficante et al. | D7/622 |
| D615,366 | S | * | 5/2010 | Berezansky | D7/622 |
| 7,909,202 | B1 | * | 3/2011 | Gordon | 220/742 |
| D643,289 | S | * | 8/2011 | Harlan | D9/455 |
| 2003/0183640 | A1 | * | 10/2003 | Bissell | 220/741 |
| 2004/0195849 | A1 | * | 10/2004 | Coppotelli et al. | 294/33 |

FOREIGN PATENT DOCUMENTS

| | | | |
|---|---|---|---|
| GB | 2128878 | A | 5/1984 |
| JP | 2004099101 | A | 4/2004 |

* cited by examiner

ADJUSTABLE HANDLE FOR ATTACHMENT TO A PLASTIC BOTTLE

TECHNICAL FIELD

The present invention relates to a handle for a plastic bottle.

BACKGROUND TECHNOLOGY

Conventionally, a handle like that described for example in JP 3,754,012 are known. This handle has a frontal head part for the neck part of the bottle, an insertion part for attachment for the groove at the lower part of the bottle body, and a connecting part that connects the frontal head part and the insertion part for attachment. A space where the hand can be inserted is provided between the connecting part and the bottle body, and this connecting part is configured such that it functions as the user's handle.

However, in the case of the handle described above, the connecting part for the handle takes a wide space in the state where it is attached to the bottle, and the storage for the pockets of a refrigerator, etc. is poor. In addition, because the insertion part for attachment of the handle is hung in the groove of the bottle body at the time of attachment, it is not possible to attach it well owing to the design (shape, size) of this groove, and stably supporting the bottle is difficult.

In particular, such an attachment method is ill suited for lightweight bottles. It has reached the point where a bottle body with lighter weight is deformed flexibly and readily. Owing to this, when the insertion part for attachment of the handle is hung in groove of the bottle body, there is a chance that the bottle body may be deformed. Not only that, but also when the bottle is tilted when the contents are being poured after attachment, the bottle body is subject to the pressure from the insertion part for attachment at only the groove, so the bottle body is deformed with this as the starting point, and there is a chance that the support of the bottle may become unstable.

The present invention was created in view of the above background, and takes as its purpose the provision of a handle that can ensure the storability to a pocket, etc. of a refrigerator even in a state where it is attached to a bottle, and that in addition can provide stable support even for a bottle whose weight is to be lightened.

SUMMARY OF THE INVENTION

In order to achieve the above-mentioned purposes, the inventive handle is provided with a neck supporting part that is composed in such a manner that it mates with the neck of a bottle made of plastic and supports this, a bottom supporting part that is composed in such a manner that it receives the bottom of the bottle and supports the bottom of said bottle, and a gripping part that connects the neck supporting part and bottom supporting part. The neck supporting part has a first engagement part and a second engagement part with which the neck can engage and disengage. The gripping part exists as an extension in the vertical direction in such a manner that it runs along the body of the bottle in the event that the neck is engaged with the first engagement part, and exists as an extension that is slanted relative to the vertical direction in such a manner that it draws apart from the bottle in the event that the neck is engaged with the above-mentioned second engagement part.

According to the present invention, if the neck of the bottle is engaged in the first engagement part when the bottle is to be stored in the pocket of the refrigerator, etc., it is possible to make the gripping part approach the body of the bottle. Owing to this, the gripping part does not occupy a wide space, so it is possible to ensure the storability in this kind of bottle. On the other hand, if the neck of the bottle is engaged in the second engagement part when the bottle is handled, such as lifting the bottle and pouring the contents of the bottle, it is possible to form a larger space between the upper part of the inclined gripping part and the bottle than in the engaged state with the first engagement part. Owing to this, the user can insert his hand into this space and hold the gripping part, and easy handling of the bottle is enabled.

In addition, because the support position of the handle relative to the bottle becomes the up-down position of the bottle that is the neck part and the lower portion of the bottle, the movement when tilting the bottle and pouring out its contents is stable. Moreover, it is configured such that the support of the lower portion of the bottle can be performed by receiving the bottom of the bottle. Owing to this, it is not greatly affected by the design of the bottle body, and it is possible to support the bottle stably, even in the case of a lightweight, flexible bottle.

Preferably, the bottom supporting part supports in such a manner that it envelopes the lower portion of the bottle. According to this configuration, because the holdability (controllability) of the lower portion of the bottle is improved, it is possible to support the bottle more stably. As the mode for supporting the bottle in such a manner that the lower portion of the bottle is enveloped, one can cite a mode wherein the bottom supporting part faces on the entire region of the of the lower portion of the bottle, and in addition a mode in which it faces over the entire periphery on at least one region of the lower portion of the bottle.

More preferably, the bottom supporting part may have a first side plate part that receives the bottom of the bottle, a second side plate part that extends upwards from the bottom plate part towards the gripping part, and a pair of third side plate parts that connect the first side plate part and the second side plate part in such a manner that they envelope the lower portion of the bottle in addition to the first side plate part and the second side plate part. According to this configuration, it is possible to support the bottle in such a manner that the lower portion of the bottle is enveloped by the first to third side plate parts. The pair of third side plate parts is formed such that they are opposed to one another, but the positions thereof in the up-down direction may be the same or it may be different.

More preferably, the third side plate part is positioned upwards from the bottom plate part. According to this configuration, compared to a case in which the third side plate part is formed in such a manner that it stands erect slightly from the bottom plate part, when for example the bottle is tilted, the third plate part ends up supporting a spot that is the upper part of the lower portion of the bottle. Therefore, it is possible to further improve the holdability of the lower portion of the bottle.

More preferably, projecting parts that slot into the groove of the bottle may be formed on at least one of the first side plate part and the second side plate part. According to this configuration, the lower portion of the bottle can escape the force it receives from the first or second side plate part when the bottle is for example tilted through the projecting parts on the groove, which realizes the effect of reinforcement of the bottle, so it is possible to inhibit the deformation of the lower portion of the bottle. In addition, the holdability of the bottle is also improved. It is still more preferable that the projecting parts are position higher than the third side plate part.

Preferably, a leg for placing said bottle horizontally may be formed on the outer surface of the first side plate part. According to this configuration, since it is possible to place the handle and a bottle with a handle attached horizontally, it is possible to improve the ease with which these are handled. In addition, it is possible to utilize efficiently the first side plate part for supporting the lower portion of the bottle, and to provide a leg.

More preferably, in the event that the neck is engaged with the first engagement part, the leg may be formed in such a manner that it does not protrude more to the outside than the gripping part. According to this configuration, in the event that the bottle is stored in a state in which it is placed vertically in the pocket, etc. of a refrigerator, the leg for horizontal placement does not become a hindrance. Therefore, the storability is not impaired, and it can be provided for uses involving both vertical placement and horizontal placement.

According to another preferable mode of the present invention, the bottom supporting part may have a bottom plate part that receives the bottom of the bottle, a tubular peripheral wall part that extends upwards from the bottom plate part, and an opening is formed intermittently in the peripheral direction for the peripheral wall part. According to this configuration, it is possible to support in such a manner that the lower portion of the bottle is enveloped, even while providing for lighter weight of the bottom supporting part.

Preferably, the first engagement part is positioned on the gripping part side, and moreover the second engagement part is positioned on the side opposed to the gripping part in such a manner that it is opposed to the first engagement part, and the neck supporting part may have an opening part in the space between the first engagement part and the second engagement part that can pass through in the horizontal direction when the neck engages with the first engagement part or engages the second engagement part. According to this configuration, because the first engagement part and second engagement part are positioned in such a manner that they are opposed to one another, the movement when changing the engaged state is easier. In addition, it is possible to employ a common opening part and to move to any of the engaged states.

Preferably, the gripping part may have a changed part wherein the inner surface of the upper side part has added changes compared to the inner surface of the lower side part. According to this configuration, it is possible to make the user aware about gripping the upper side portion of the gripping part. In addition to the degree that changes are added, the rigidity thereof can also be increased.

More preferably, the changed part may be formed by at least one of the step parts. According to this configuration, because it becomes a device to prevent slipping when the user grips it, it is possible to improve the portability and the ease of pouring.

Preferably, the lower end part of the gripping part may have a rigidity that is lower than that of at least one part of the upper end part thereof, in such a manner that the gripping part bends with said lower end part of said gripping part as the fulcrum when there is a change between a state in which the neck is engaged in the first engagement part and a state in which it is engaged in the second engagement part. According to this configuration, the movability of the gripping part when the engagement state is changed can be performed smoothly. In addition, because the lower end part of the gripping part is used as the fulcrum of the bending, even if the angle of inclination of the gripping part when the neck is engaged in the second engagement part is small, it is possible to increase as much as possible the space that is formed between the upper part of the gripping part and the bottle.

Preferably, the gripping part may have a pair of flange parts that extend towards the outside in opposed to one another, between but not including the upper end part and lower end part of the gripping part. According to this configuration, because the sectional secondary moment becomes larger at the up-down intermediate portion of the gripping part, it is possible to increase the rigidity of the up-down intermediate portion of the gripping part, and the ease of handling of the handle as experienced by the user (portability and ease of pouring) improves. On the other hand, since the rigidity of the lower end part of the gripping part becomes lower, it is bent more easily with this lower end part as the fulcrum, and it is possible perform smoothly the movability of the above-described gripping part.

Preferably, the upper end part of the gripping part may have a curved wall part that is curved upwards. According to this configuration, it is possible to form a finger rest between the curved wall part and the upper part of the bottle. Owing to this, naturally in the event that the neck is engaged in the second engagement part, but even in the event that it is engaged in the first engagement part, it becomes possible to improve the portability of a handle that employs the space for a finger rest.

DESCRIPTION OF THE INVENTION

A description is provided for the handle of a plastic bottle for an optimal mode of embodiment of this present invention, with reference to the attached figures. In the following description, the side on which the bottle mouth is present is the upper side, and the side on which the bottle bottom is present is the lower side. Height means length along the direction (up-down direction) of the central axis of the bottle.

First of all, a description of the composition of the plastic bottle is provided.

Figure 5:
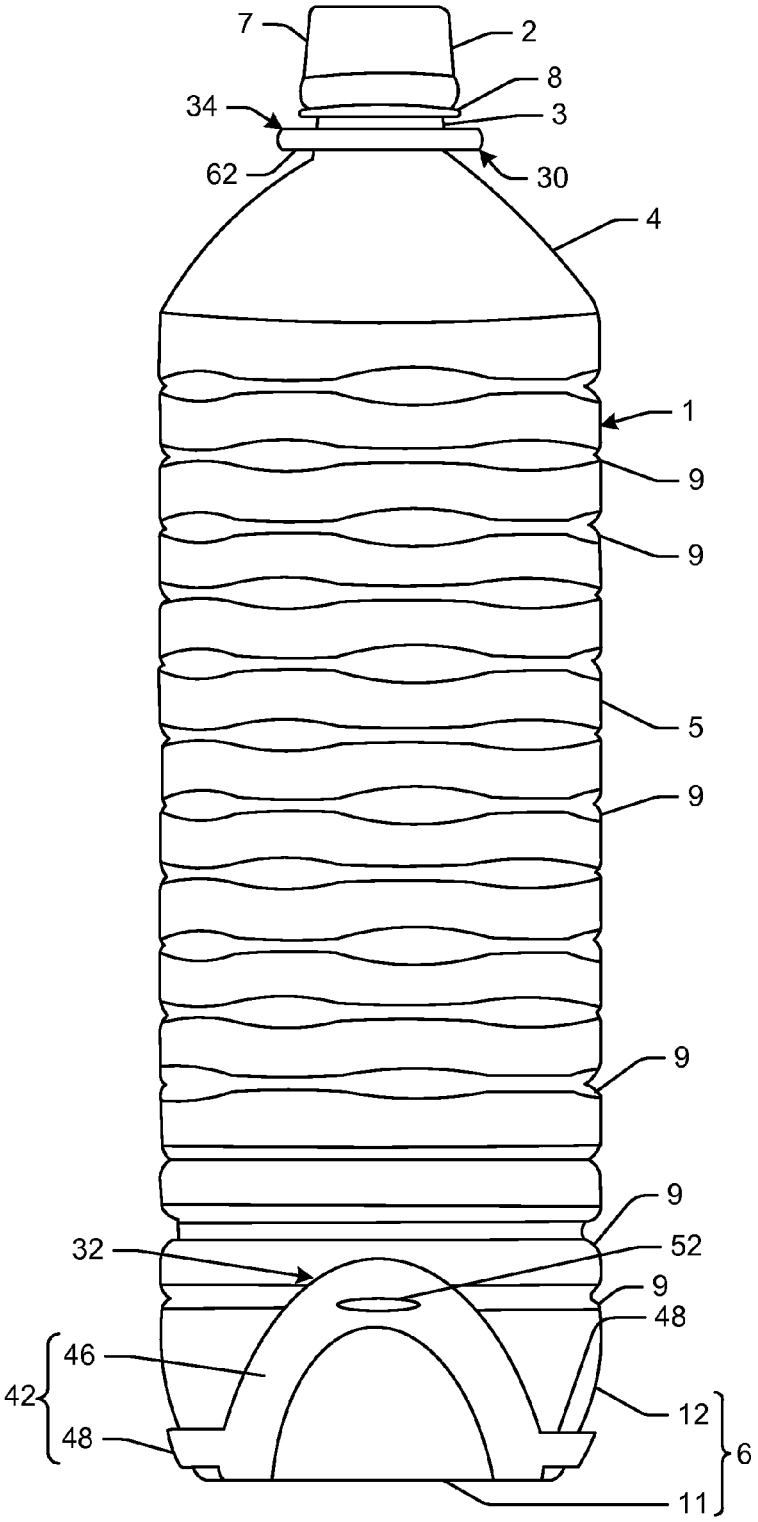
FIG. 5 is a right left figure of FIG. 1.

As shown in FIG. 5, the plastic bottle 1 (hereinafter, "bottle 1") has, in order from the top, a mouth 2, neck 3, shoulder 4, body 5 and bottom 6. Each of these parts 2-6 has as its chief material a thermoplastic resin such as polyethylene, polypropylene, polyethylene terephthalate, etc. They are formed from a perform into a monobloc by biaxial stretch blow molding or direct blow molding, and compose a tubular bottle wall with a bottom for holding various liquids, such as beverages, alcohol and liquids that contain oil, therein. The mouth 2 is a cylindrical locus that opens the upper end, a screw part to which a cap 7 is screwed is formed on the outer peripheral surface thereof, and a bead ring is formed on the lower side of the screw part. The neck 3 has a support ring 8 that projects in a flange shape on the position bordering on the mouth 2, and a tubular peripheral wall at the lower side of the support ring 8 is connected to the upper end of the shoulder 4. There are cases where the bead ring and the support ring are called the flange and the neck ring. In addition, the bead ring may be omitted depending on what the end use of the bottle is.

Here, even in the event that the bottle is made lightweight and its flesh is made thin, in general, the peripheral wall of the neck 3 is a portion that is not stretched by biaxial stretch blow molding, or is a portion that is left as is with thick flesh compared to the shoulder 4 and the body 5 even if it is stretched. Owing to this, the rigidity (strength) of the peripheral wall of the neck 3 is greater than that of the shoulder 4 and the body 5. As for the shoulder 4, the cross-section gradually enlarges towards the bottom, and the shoulder 4 is connected to the upper end of the body, which comprises the maximum width in the bottle 1. The body 5 is a tubular portion that extends in lengthy manner in the up-down direction, and a plurality of reinforcing grooves 9 have been formed on the peripheral wall thereof. The sectional shape of the body 5 can be made polygonal such as a square or rectangle, but here it has been made round. The bottom part 6 has been composed by a bottom wall 11 and a peripheral wall 12. The peripheral wall 12 has been made slightly narrower in the downward direction, and the bottom end of the body 5 is connected to the bottom wall 11. There are no particular restrictions on the shapes of the mouth 2, neck 3, shoulder 4, body 5 and bottom 6, and they can be designed as need dictates.

Next, a description is provided about the composition of the handle 30 for the Embodiment 1.

Figure 1:
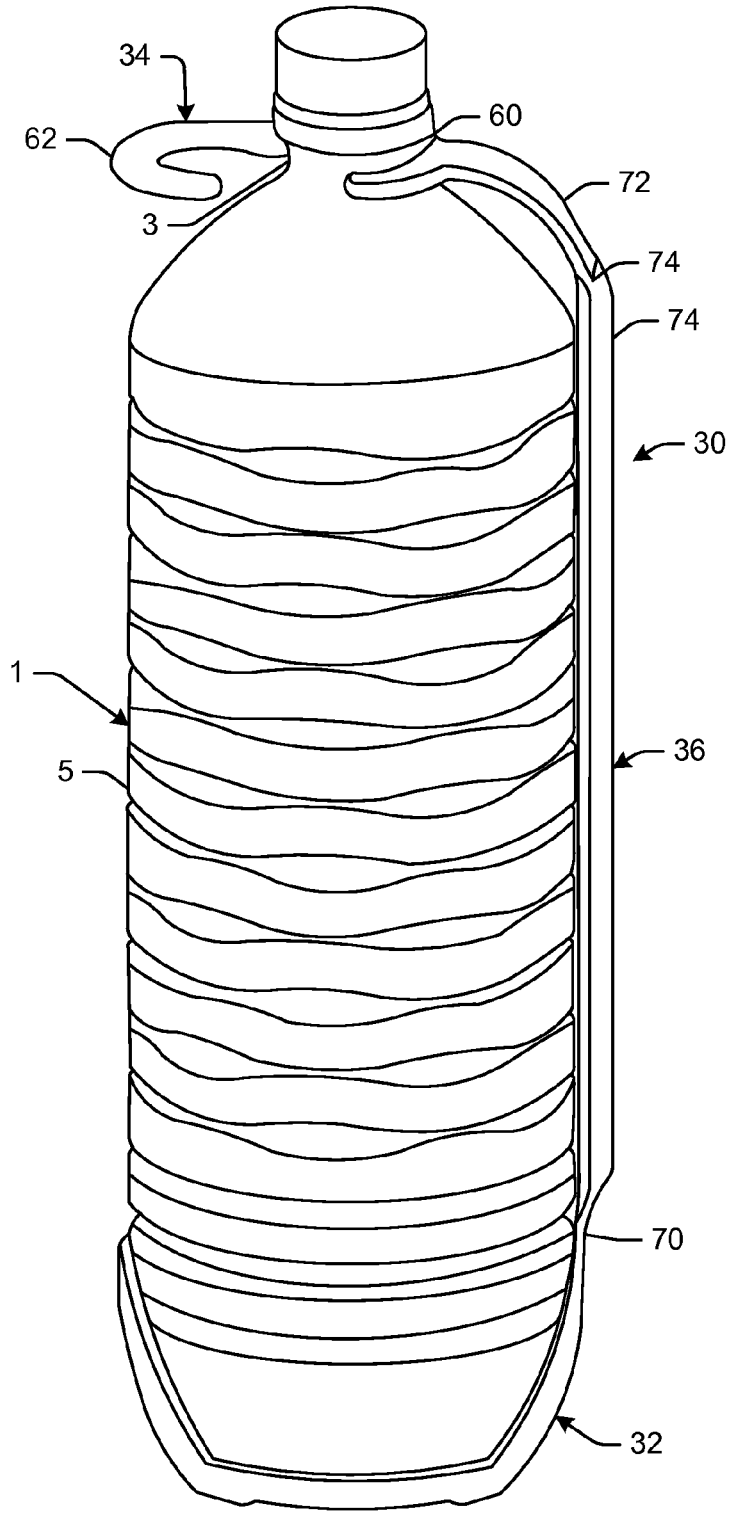
FIG. 1 is a figure showing a state in which the handle for the Embodiment 1 is attached to the bottle, and a figure in which the neck of the bottle is engaged with the first engagement part.
Figure 2:
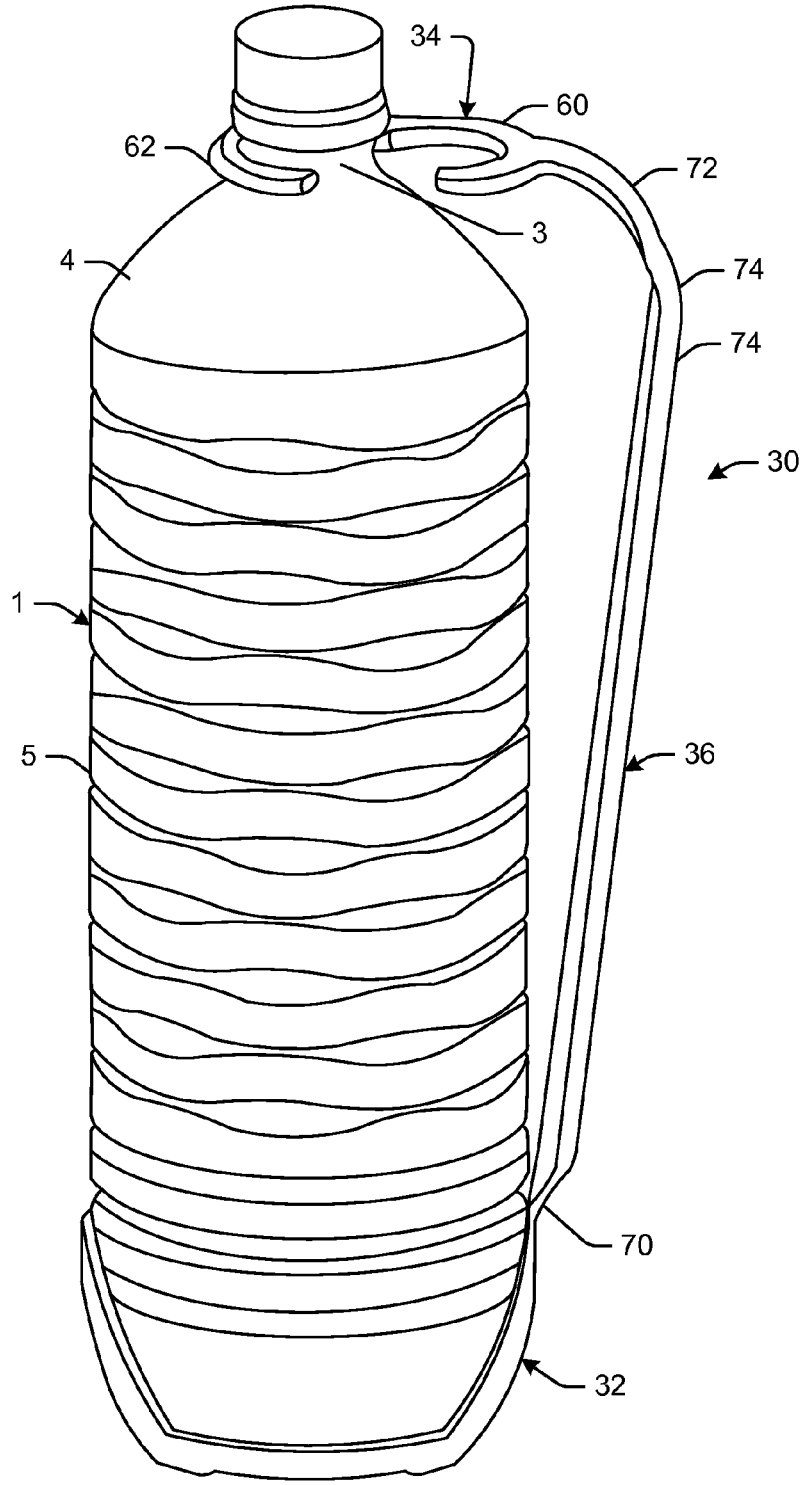
FIG. 2 is a figure showing a state in which the handle for the Embodiment 1 is attached to the bottle, and a figure in which the neck of the bottle is engaged with the second engagement part.
Figure 3:
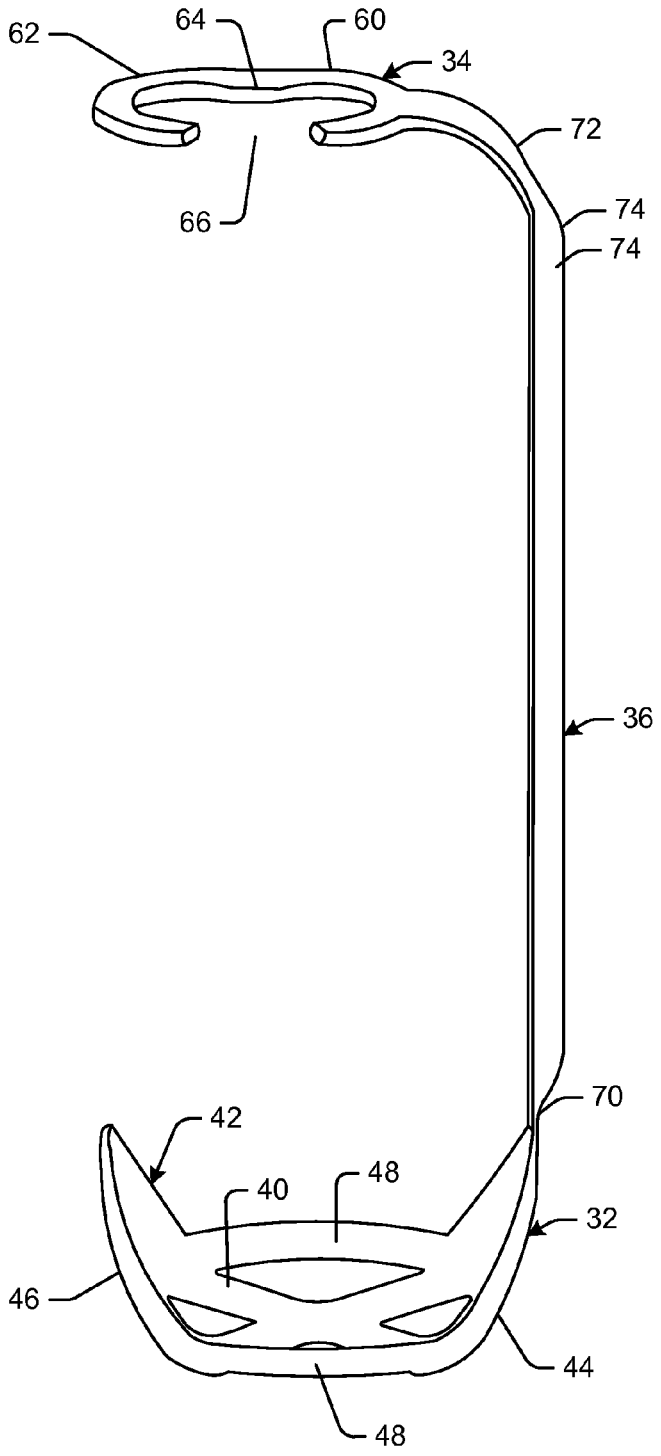
FIG. 3 is an oblique view showing the handle for the Embodiment 1.

As shown in FIG. 1 to FIG. 3, broadly categorizing, the handle 30 is equipped with a bottom supporting part 32 that receives the bottom of the bottle 1 and supports the lower portion of the bottle, a neck supporting part 34 that mates with the neck 3 of the bottle 1 and supports this, and a gripping part 36 that connects the bottom supporting part 32 and the neck supporting part 34. The lower portion of the bottle 1 means the portion that includes at least the bottom part 6 of the bottle 1, and it may include or may not include the lower part of the body 5 of the bottle 1.

For the handle 30, the bottom supporting part 32, the neck supporting part 34 and the gripping part 36 are formed in a monobloc, and the bottom supporting part 32, the neck supporting part 34 and the gripping part 36 respectively have a thin plate-like thickness. The handle is made of an elastic and deformable hard material, and has a rigidity that can support the bottle 1 to be lifted. It is preferable that an acrylic resin be employed as such a material, but it is not limited to this, and another hard plastic may be employed, for example, recyclable PET resin, etc. may be employed. In addition, it is also possible to employ various materials such as metal, wood, bamboo, etc. It is also possible to compose the bottle 1 by forming as a separate body at least one of the bottom supporting part 32, the neck supporting part 34 and the gripping part 36, and joining these with an adhesive agent, etc.

The bottom supporting part 32 has been composed overall in such a manner that it provides support such that it envelopes the lower portion of the bottle 1 (see FIGS. 1, 2, 4 and 5). As shown in FIGS. 3-5 and FIG. 7, this kind of bottom supporting part 32 is equipped with a bottom plate part 40 that receives the bottom wall 11 of the bottle 1, and the peripheral wall part 42 that stands erect from the bottom plate part 40.

The bottom plate part 40 may be something that receives the entire surface or a part of the bottom wall 11 of the bottle 1 when the latter is loaded, and here it is formed in a cross shape in a planar view. In addition, the bottom plate part 40 may be formed in such a manner that only the reverse surface of the bottom plate part 40 is formed as an installation surface when a bottle 1 to which the handle 30 is attached is placed upright, or it may be formed in such a manner that a part of the bottom wall 11 of the bottle 1 serves as the installation surface along with the reverse surface of the bottom plate part 40. As the latter mode, one can imagine a case in which the bottom plate part 40 is mated into a pre-formed depression of the bottom wall 11, and here it has been formed in such a mode.

The peripheral wall part 42 has a first side wall part 44, which extends upwards from the bottom plate part 40 towards the gripping part 36, a second side wall part 46, which extends upwards from the bottom plate part 40 towards the side opposed to the gripping part 36, and a pair of third side wall parts 48, 48, which connect the first side wall part 44 and the second side wall part 46 respectively with the front side and the back side of the bottle 1. The third side wall parts 48, 48 support in such a manner that they envelope the peripheral surface of the lower portion of the bottle 1 along with the first side wall part 44 and second side wall part 46.

Figure 4:
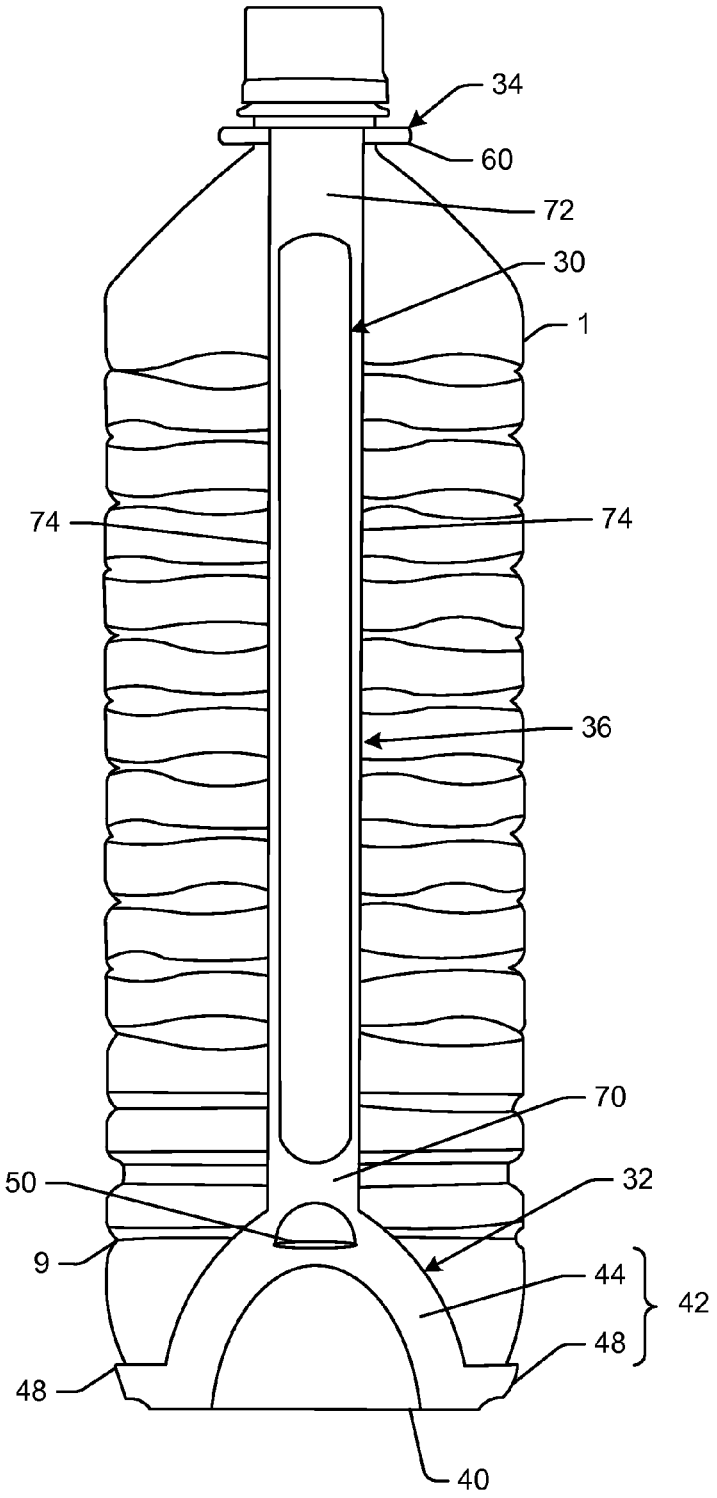
FIG. 4 is a right side figure of FIG. 1.
Figure 7:
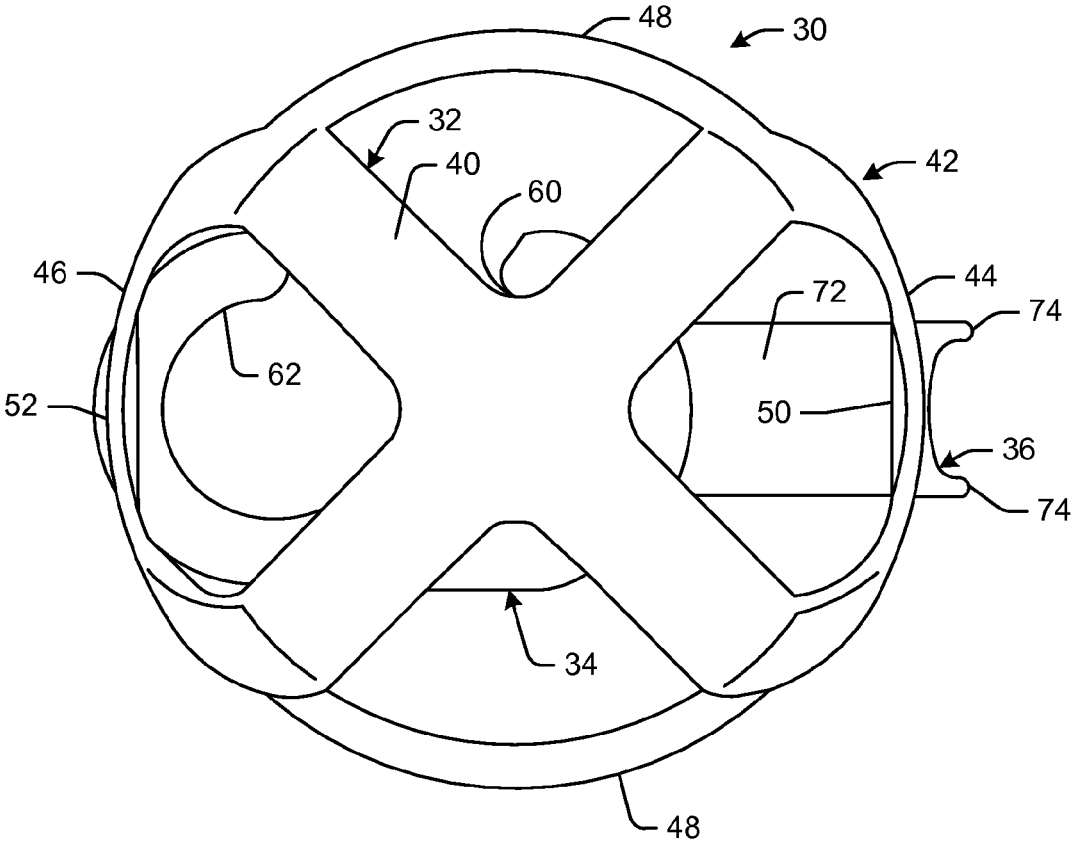
FIG. 7 is a surface figure of FIG. 3.

As shown in FIG. 4, the first side wall part 44 is a spot exhibiting a rough inverted U-shape in right side section view, and the roughly inverted U-shaped apex is connected to the lower end part 70 of the gripping part 36, and moreover the skirt part of both roughly inverted U-shaped ends is connected to the bottom plate part 40. As shown in FIG. 7, the inner surface of the first side plate part 44 is composed as a curved surface, in such a manner that it corresponds to the curved shape of the lower portion of the bottle 1. A dash-shaped projection part 50 that extends in the peripheral direction has been formed on the inner surface of the apex of the first side plate part 44. The projecting part 50 is formed in such a manner that it slots into the groove 9 of the lower portion of the bottle, in a state in which the handle 30 is attached to the bottle 1 (see FIG. 4).

The second side plate part 46 has been formed in opposition to the first side plate part 44. As in the case of the first side plate part 44, as shown in FIG. 5 and FIG. 7, the second side plate part 46 is formed as a spot that exhibits a rough inverted U-shape in left side section view, and serves as the inner surface corresponding to the curved shape of the lower portion of the bottle 1. While the skirt part of both roughly inverted U-shaped ends of the second side plate part 46 is connected to the bottom plate part 40, the roughly inverted U-shape apex is in a free state, and a projecting part 52 has been formed on the inner surface thereof. The projecting part 52 has the same shape as the projecting part 50, and moreover has been formed in opposition to the projecting part 50, and is configured such it slots into the groove 9 of the lower portion of the bottle, in a state in which the handle 30 is attached to the bottle 1 (see FIG. 5).

As shown in FIG. 4 and FIG. 5, the third side plate parts 48, 48 have been composed as belt-like spots that cover only an approximately ¼ arc in the peripheral direction, downwards from the projecting parts 50, 52, and the lower ends thereof are position at the same height level as the upper surface of the bottom plate part 40. In addition, as shown in FIG. 7, the third side plate parts 48, 48 have an inner surface corresponding to the curved shape of the lower portion of the bottle 1.

Here, the first to third side plate parts 44, 46, 48, 48 may be composed in such manner that they face the lower portion of the bottle 1, in a state in which the handle 30 is attached to the bottle 1, and they come into contact with the lower portion of the bottle 1 in the event that the bottle 1 is tilted and support it such that they envelope it. In other words, in a state in which the bottle 1 is not tilted, there is no need for the first to third side plate parts 44, 46, 48, 48 to be in close contact with the inner surface of the lower part of the bottle 1. The mode of the first to third side plate parts 44, 46, 48, 48 is not limited to the above-mentioned mode. For example, the position or size in the up-down direction towards one another of the third side plate parts 48, 48 may be different.

Figure 6:
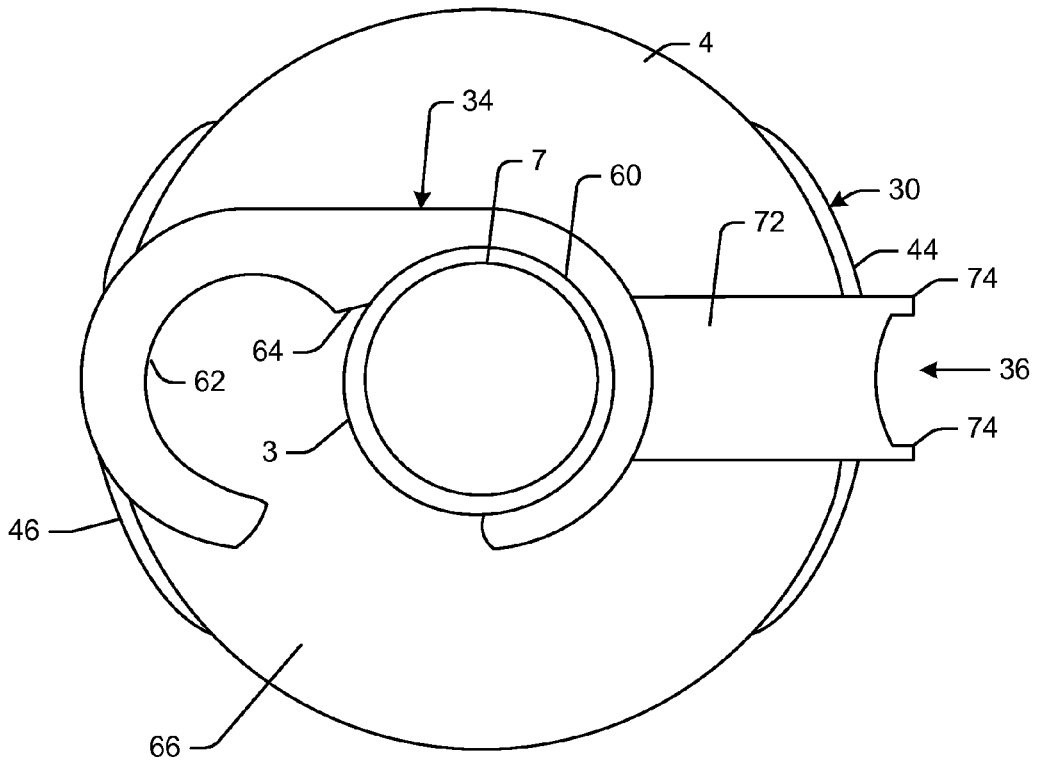
FIG. 6 is a plan of FIG. 1.

As shown in FIG. 3 and FIG. 6, the neck supporting part 34 has, in such a manner that they are connected in the horizontal direction, a first engagement part 60 and a second engagement part 62 that engage such that the neck 3 of the bottle 1 can engage and disengage. The first engagement part 60 is positioned at the side of the gripping part 36, and the second engagement part 62 is positioned at the side opposed to the gripping part 36. Both the first engagement part 60 and a second engagement part 62 are roughly C-shaped plate-like spots in which an annular part has been notched, and have been formed in opposition to each other, in such a manner that the respective notched portions face slightly towards the frontal side.

While a place at the back sides of the first engagement part 60 and a second engagement part 62 is connected by a connecting part 64, the frontal sides face one another with an opening part 66 present there. In other words, a connecting part 64 and an opening part 66 are positioned between the first engagement part 60 and a second engagement part 62. The inner surface of the connecting part 64 is formed in an arc shape, and is configured such that it can receive the peripheral wall of the neck 3 of the bottle 1. The opening part 66 has an opening width through which the neck 3 can pass in the horizontal direction. This opening width is formed in such a manner that it becomes narrower from the frontal side towards the back side, in such a manner that it facilitates the entry of the neck 3 into the opening part 66, and moreover it is hard for it to emerge from the opening part 66 in a free state, and it is preferable that the minimum opening width be slightly smaller than the diameter of the neck 3.

When the neck 3 is mated with the first engagement part 60 or second engagement part 62, first of all, the neck 3 is inserted into the opening part 66 from the horizontal direction. When the diameter of the neck 3 is smaller than the opening width of the opening part 66, it causes flexible deformation in such a manner that the opening rim of the opening part 66 is expanded. Next, it is configured such that the neck 3 is inserted into the notched portion of the first engagement part 60 or second engagement part 62, and it causes flexible deformation in such a manner that the engagement part is expanded, and pressed into it. When this happens, it is configured such that the finally engagement part that is pressed in (the first engagement part 60 or second engagement part 62) elastically reverts to its original state, and it engages over a region larger that the semi-circular region of the peripheral wall of the neck 3, and the neck 3 does not come loose in the horizontal direction easily or in a free state. Owing to this, the neck 3 engages with the neck supporting part 34 and is supported. At this time, the neck 3 is prevented from coming loose upwards from the neck supporting part 34 by the support ring 8 of the bottle 1.

In the event that the neck 3 that is engaged with the first engagement part 60 is caused to engage with the second engagement part 62, the notched portion of the first engagement part 60 is expanded and the neck 3 is removed, and it may be pressed into the second engagement part 62 as described above. In addition, in the event that the neck 3 is removed from the neck supporting part 34, the opening rim of the opening part 66 may be expanded and the neck part may be removed from the horizontal direction.

As shown in FIG. 1, the gripping part 36 exists as an extension in the vertical direction in such a manner that it runs along the body 5 of the bottle 1 in the event that the neck 3 is engaged in the first engagement part 60. On the other hand, as shown in FIG. 2, the gripping part 36 exists as an extension that is inclined relative to the vertical direction in such a manner that the upper part of the gripping part 36 draws apart from the bottle in the event that the neck 3 is engaged in the second engagement part 62. The lower end part 70 of the gripping part 36 is composed with rigidity that is lower than the upper side portion thereof, in such a manner that the movability of such a gripping part 36 becomes smoother.

Specifically, the gripping part 36 has a pair of flange parts 74, 74 that extend towards the outside in opposition to one another, between but not including the lower end part 70 and the upper end part 72. The flange parts 74, 74 are separated from one another by just the width of the gripping part 36. To cite one example of that width, the thumb of an adult is about the extent of what is housed between the flange parts 74, 74. Since the sectional secondary moment of the up-down intermediate portion of the gripping part 36 becomes larger due to such flange parts 74, 74, the rigidity of the up-down intermediate portion of the gripping part 36 is raised. Since at the same time the rigidity of the lower end part 70 of the gripping part becomes lower, the gripping part 36 tends to become bent, with the lower end part 70 as the fulcrum, when it changes between the engagement state shown in FIG. 1 and the engagement state shown in FIG. 2. The upper end part 72 of the gripping part 36 has been formed at an arc-shaped spot that connects the upper side portion of the gripping part 36 and the side of the first engagement part 60 of the neck supporting part 34, but it is not limited to this, and it may be formed in any mode that connects at a right angle the upper side portion of the gripping part 36 and the side of the first engagement part 60 of the neck supporting part 34.

In the engaged state shown in FIG. 1, as far as the handle 30 composed in this manner is concerned, the gripping part exists as an extension in the vertical direction without any gap or almost without any gap between it and the body of the bottle 1. At this time, as shown in FIG. 6, it is configured such that the second engagement part 62 does not protrude greatly more to the outside than the second side plate part 46 of the bottom supporting part 32, and preferably it does not protrude more to the outside than the second plate side part 46. The maximum width of a bottle 1 with a handle 30 in the engaged state shown in FIG. 1 is the size whereby it fits in the pocket of a refrigerator, and it is set for example at 109 mm. In addition, when the bottle 1 with a handle 30 in the engaged state shown in FIG. 1 is placed horizontally in such a manner that the gripping part 36 becomes the lower side, it is configured such that it is supported along the up-down direction by the flange parts 74, 74.

On the other hand, in the engaged state shown in FIG. 2, as the gripping part 36 faces upwards, it gradually draws apart from the bottle 1, and a large space is formed between it and the upper part of the bottle 1. The width of this space (the distance between the gripping part 36 and the bottle 1) is a maximum of about 30 mm between the gripping part 36 and the shoulder 4, and the user can insert his hand in this space and grip the gripping part 36. Based on the design, the width of said space can be adjusted as needed by the position of the second engagement part in the neck supporting part 34. However, based on the standpoint of storability, as noted above, the position of the second engagement part 62 is set at the position where it does not protrude greatly more to the outside than the second side plate part 46 of the bottom supporting part 32, at the very least.

A description is now provided of the action effects of the handle 30 in this mode of embodiment as described above.

First of all, in order to attach the handle 30 to the bottle 1, in order to attach the handle 30 to the bottle 1, the lower part of the bottle 1 is placed on the bottom supporting part 32, the neck 3 of the bottle 1 is inserted into the opening part 66 from a horizontal direction, and the neck 3 is caused to engage with the first engagement part 60 or the second engagement part 62. It is configured such that the handle 30 that is attached in this manner supports the up-down portions of the bottle 1, and the user can undertake an operation such as holding the gripping part 36 and carrying the bottle 1, or pouring out the contents of the bottle 1.

In the event that the operation of carrying the bottle 1 is performed, if the neck 3 is engaged in the second engagement part 62 as shown in FIG. 2, a large space in which the hand can be inserted is formed between the upper part of the inclined gripping part 36 and the bottle 1. Owing to this, the user can easily operate the handle 30. Moreover, it can be operated by placing the thumb between the flange parts 74, 74, or placing the thumb on the arc-shaped upper end part 72 of the gripping part 36, so it is easy to operate.

On the other hand, in the event that it is stored in the pocket, etc. of a refrigerator, if the neck 3 is engaged in the first engagement part 62 as shown in FIG. 1, the gripping part 36 is positioned in such a manner that it approaches the body 5 of the bottle 1 and runs along this. If the gripping part 36 is folded up in this manner, the gripping part 36 does not occupy a wide space, and in the event that the bottle 1 with a handle 30 is placed vertically, one can ensure the storability to the pocket. To be sure, even in the event that the bottle 1 with a handle 30 is placed horizontally, the gripping part 36 does not occupy such a wide space. Moreover, since it is possible to place it horizontally with the flange parts 74, 74, even a round bottle 1 can be placed horizontally on a shelf or table, in a state that prevents it from falling down.

In addition, since the first engagement part 60 and the second engagement part 62 are positions in such a manner that they are opposed to one another, the change between the engaged state shown in FIG. 1 and the engaged state shown in FIG. 2 involves just the operations of pulling or pushing the gripping part 36 in one direction. Owing to this, it is an easily movable handle.

Moreover, since the support position of the handle 30 relative to the bottle 1 becomes the up-down position of the bottle 1, the movement when holding the handle 30, tilting the bottle 1 and pouring out the contents is stable. Moreover, the support of the lower portion of the bottle is performed by receiving the bottom of the bottle 1. Owing to this, it is not greatly affected by the design of the bottle body, and it is possible to support the bottle stably, even in the case of a lightweight, flexible bottle.

In particular, since the bottom support part 32 supports in such a manner that it envelopes the lower portion of the bottle 1, the holdability (controllability) is improved. In addition, since out of the peripheral wall of the bottom supporting part, the second side plate part 46 on the side opposed to the gripping part 36 extends upwards to a certain height from the bottom plate part 40, even if the bottle is tilted in order to pour from it, it is possible to support the bottle 1 in such a manner that it does not come free from the handle 30.

Moreover, in the event that the bottle 1 is tilted, the lower portion of the bottle 1 can escape from the force it receives from the first side plate part 44 or second side plate part 46 through the projecting part 50 or projecting part 52 on the groove 8, which achieves the effect of reinforcement for the bottle 1. Owing to this, it is possible to inhibit even more optimally the deformation of the lower portion of the bottle 1 while improving the holdability of the bottle 1 at the bottom supporting part 32. In addition, since the first side plate part 44 and the second side plate part 46 are roughly inverted U-shaped, the peripheral wall part 42 of the bottom supporting part 32 becomes something in which an opening is formed intermittently in the peripheral direction, so it is possible to aim at making the weight of the bottom supporting part 32 lighter.

Figure 8:
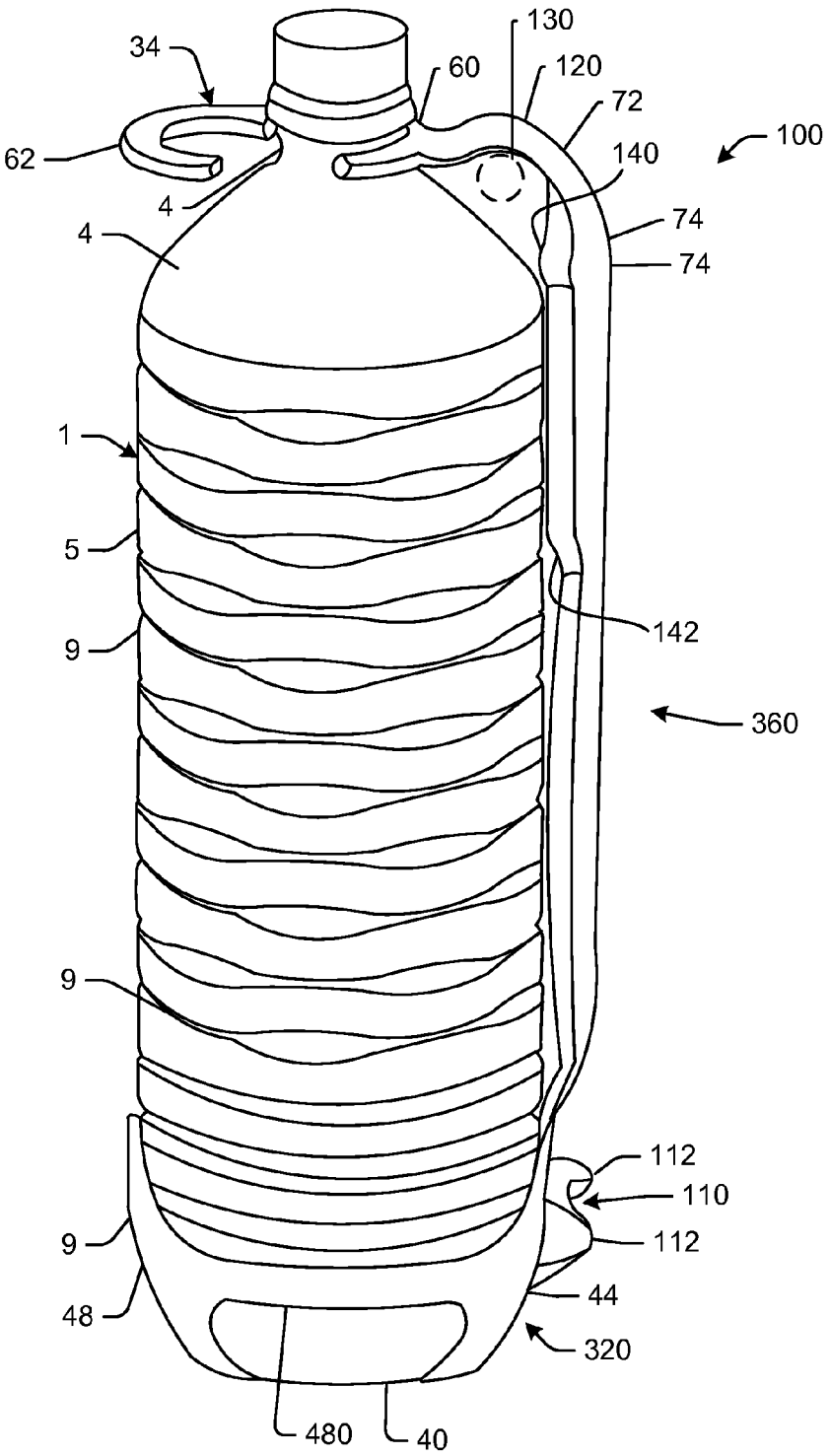
FIG. 8 is a figure showing a state in which the handle for the Embodiment 2 is attached to the bottle, and a figure in which the neck of the bottle is engaged with the first engagement part.
Figure 9:
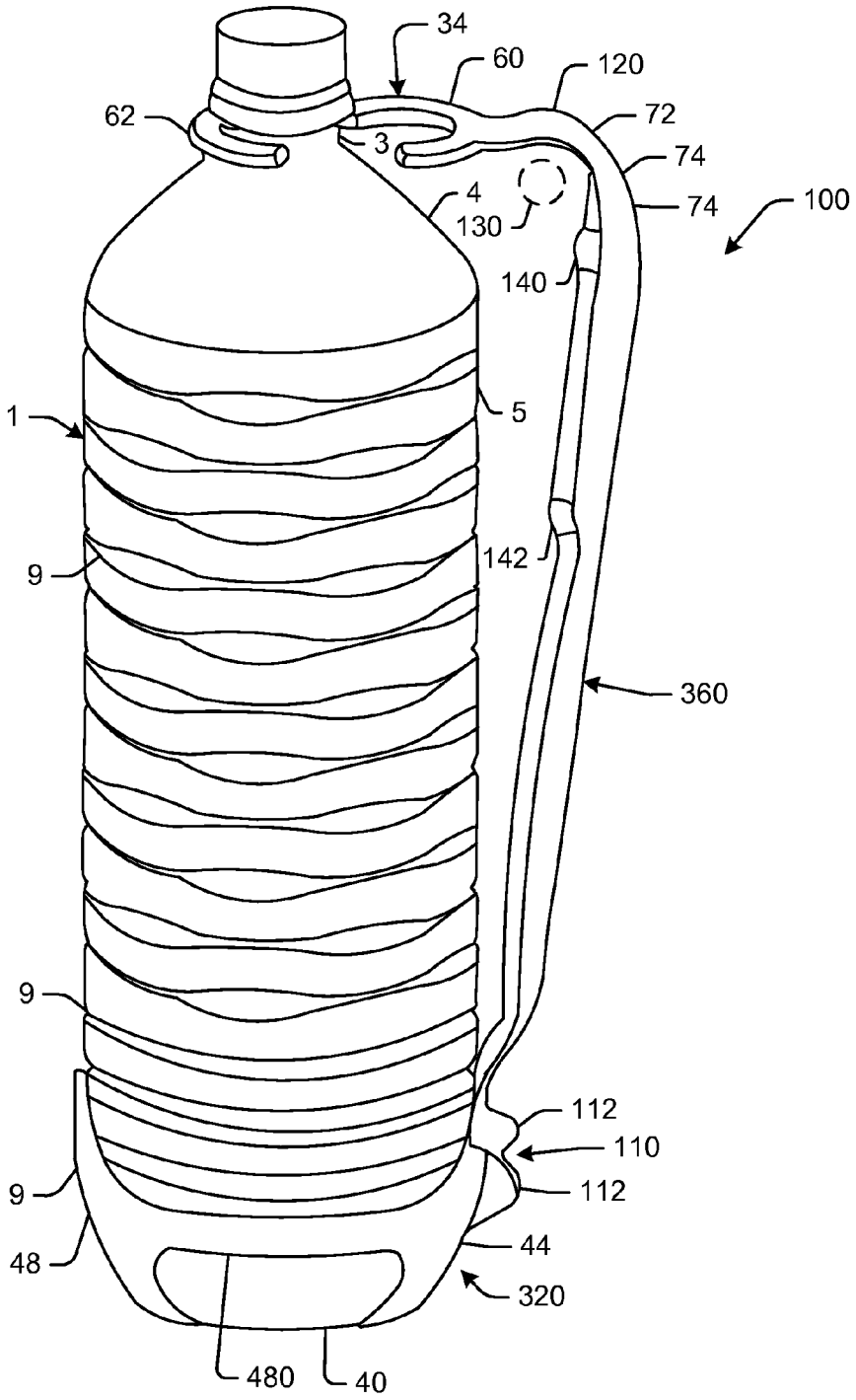
FIG. 9 is a figure showing a state in which the handle for the Embodiment 2 is attached to the bottle, and a figure in which the neck of the bottle is engaged with the second engagement part.
Figure 10:
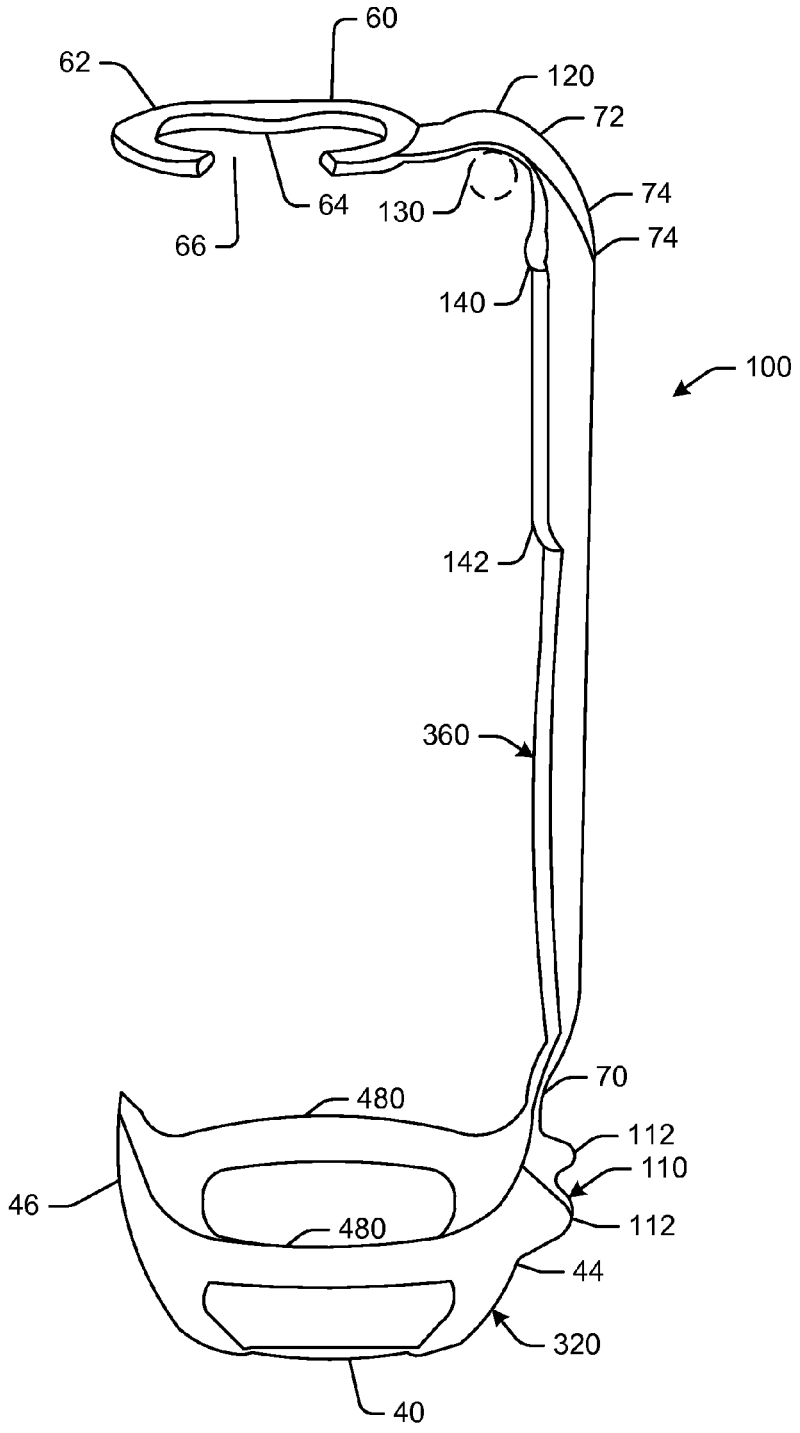
FIG. 10 is an oblique view showing the handle for the Embodiment 2.

Next, a description is provided about the handle 100 for the Embodiment 2, with the focus on differences between it and the handle 30 for the Embodiment 1, with reference to FIGS. 8-10. The chief differences are a change in the position of the third side plate 480 and the addition of a leg 110 for the bottom supporting part 320, and the addition of a curved wall part 120 and step part 140, 142 for the gripping part 360. Of the composition of the handle 100, the same numbers of the key have been used for those parts with an identical or similar composition as those in the handle 30 for the Embodiment 1, and a description thereof has been omitted.

The bottom supporting part 320 is formed in a rough bowl shape overall, in order to support in such a manner that it is enveloped from a lower portion of the bottle 1 than the bottom supporting part 32 of the Embodiment 1. More specifically, the bottom plate part 40 becomes roughly round in planar view, and the area that receives the bottom of the bottle 1 increases. In addition, the pair of third side plate parts 480, 480 is positioned upwards from the bottom plate part 40, and owing to this a lip-shaped opening is composed between it and the bottom plate part 40. The pair of side plate parts 480, 480 connects the first side plate part 44 and the second side plate part 46 by a pair of intermediate parts in the height direction thereof.

Based on such a configuration, the third side plate parts 480, 480 supports a spot above lower portion of the bottle compared to the case in the Embodiment 1, when the bottle is tilted. Therefore, it is possible to improve further the holdability of the lower portion of the bottle 1. The position or size of the third side plate parts 480, 480 in the up-down direction towards each other may be different.

The leg 110 of the bottom support part 320 is formed by protruding from the outer surface in the vicinity of the apex of the first side plate part 44, and it has a pair of installation parts 112, 112 whose gap is wider than that between the pair of flange parts 74, 74. The installation parts 112, 112 have been composed by a curved surface that protrudes in a mountain shape towards the side. In addition, the installation parts 112, 112 are in the same lateral position as the flange parts 74, 74, in the engaged state shown in FIG. 8. Owing to this, in the event that a bottle 1 with a handle 100 is placed horizontally in such a manner that the gripping part 36 becomes the lower side, it is supported by the installation parts 112, 112 and the flange parts 74, 74. At this time, the width (gap) of the installation parts 112, 112 is wider than the width (gap) of the flange parts 74, 74, so it is possible to place the bottle horizontally even more stably. In addition, in the engaged state shown in FIG. 8, since the leg 110 does not protrude more to the outside than the gripping part 360, the storability is not impaired, and it can be provided for uses involving both vertical placement and horizontal placement. Moreover, when a bottle 1 with a handle 100 is stored in the pocket, etc. of a refrigerator, it is possible to use the curved surface of the installation parts 112, 112 as a guide to the pocket.

The curved wall part 120 of the gripping part 360 is formed by curving upwards a part of the upper end part. The curved wall part 120 is curved in such a manner that a part thereof is positioned more to the upper side than the neck supporting part 34. Owing to this kind of curved wall part 120, a space 130 for a finger rest is formed between the upper end part 72 of the gripping part 360 and the shoulder 4 of the bottle 1. To cite an example of this space 130, it is about the size of a space in which the thumb of an adult can fit (diameter 1 cm or larger). Owing to this, even in either of the engaged states shown in FIG. 8 or FIG. 9, it is configured such that the user can insert his finger in the space 130 of the finger rest, and hold the handle 100. Owing to this, it is possible for example to utilize the space 130 of the finger rest when the bottle 1 is pulled up from the stored state in the pocket of the refrigerator, and moreover it is possible to utilize the space 130 of the finger rest when the bottle 1 is moved while it is being carried. Therefore, the portability of the handle that utilizes the space 130 of the finger rest and the ease of changing the engaged state are improved.

The step parts 140, 142 of the gripping part 360 are formed on the inner surface beneath the upper end part 72. The step part 140 is in a position that corresponds to the shoulder 4 of the bottle 1, and the step part 142 is in a position that is lowered by just the width of 4 fingers (about 6-8 cm) from the step part 140, at a position that corresponds to the upper part of the body 5. By providing such step parts 140, 142, when the user grips the upper side portion of the gripping part 360, the user's fingers are placed on either one or both of the step parts 140, 142, so it becomes a device to prevent slipping. In particular, when the remaining amount of liquid inside the bottle 1 decreases, there is a tendency for the position at which the user holds the gripping part 360 to become lower, but since the gripping part 360 has not only the step part 140 on the upper side but also the step part 241 on the lower side thereof, it is possible to provide a device for preventing slipping that responds adequately to such a tendency on the user's part. In addition, owing to the fact that the step parts 140, 142 have been provided, it is possible to make the user aware about gripping the upper side portion of the gripping part 360, and in addition to increase the rigidity thereof.

In another mode of embodiment, changed parts other than the step parts 140, 142 may be provided on the inner surface of the upper side portion of the gripping part 360. For example, it may be configured in such a manner that changes are added to the inner surface of the lower side portion, by doing non-slipping processing for the inner surface of the upper side portion of the gripping part 360.

As described above, according to the handle 100 for the Embodiment 2, in addition to the action effects achieved by the handle 30 for the Embodiment 1, it can achieve action effects that improve the holding property, stability during horizontal placement and portability, etc.

Concerning both the first and second modes of embodiment, although the description herein dealt with a round bottle as the bottle 1, it goes without saying that one can apply the handles 30, 100 to bottles shaped like a polygon, such as a square or rectangle. In this case, the bottom supporting parts 32, 320 may be configured in a shape that corresponds to the polygonal shape of the bottle 1. In addition, in the case of a bottle 1 whose body 5 has an hourglass shape, it is possible to ensure a larger space owing to the space between the inclined gripping part 36, 360 and the body 5, so the gripping part 36, 360 becomes even easier to hold.

I claim:

1. A handle for a bottle with a neck, a bottom, and a body, the handle comprising:

a neck supporting part that mates with and supports the neck of the bottle, wherein the neck supporting part comprises a first engagement part and a second engagement part;

a bottom supporting part that receives and supports the bottom of the bottle, wherein the bottom supporting part comprises:

a bottom plate part that receives the bottom of the bottle, a first inverted U-shaped side plate part having ends and an apex, wherein the ends of the first inverted U-shaped side plate part connect to and extend upward from the bottom plate part, wherein the apex of the first inverted U-shaped side plate part connects to the gripping part, a second inverted U-shaped side plate having ends and an apex, wherein the ends of the second inverted U-shaped side plate connect to and extend upward from the bottom plate part on a side opposed to the gripping part, wherein the apex of the second inverted U-shaped side plate is in a free state, and a pair of third side plate parts that connect the first side plate part and the second side plate part in such a manner that they envelope the lower portion of the bottle in addition to the first side plate part and the second side plate part;

a gripping part that connects the neck supporting part and the bottom supporting part;

a connecting part that connects the first engagement part with the second engagement part;

an opening part disposed opposite the connecting part in a space between the first engagement part and the second engagement part;

a first configuration with the gripping part extending in a substantially vertical direction along the body of the bottle with the neck engaged with the first engagement part; and a second configuration with the gripping part extending in a substantially slanted direction relative to the substantially vertical direction so as to draw apart from the bottle with the neck engaged with the second engagement part.

2. The handle described in claim 1, wherein the bottom supporting part envelopes a lower portion of the bottle.

3. The handle described in claim 1, wherein the third side plate parts are positioned upwards from the bottom plate part.

4. The handle described in claim 3, wherein projecting parts that slot into a groove of the bottle have been formed on at least one of the first side plate part and the second side plate part.

5. The handle described in claim 1, wherein a leg for laying the bottle horizontally is formed on an outer surface of the first side plate part.

6. The handle described in claim 1, wherein:

the first engagement part is positioned adjacent to the gripping part, and the second engagement part is positioned on a side opposed to the gripping part and opposed to the first engagement part.

7. The handle described in claim 1, wherein the gripping part comprises a changed part.

8. The handle described in claim 7, wherein the changed part is formed by at least one step part.

9. The handle described in claim 1, wherein a lower end part of the gripping part has a rigidity that is lower than at least one part of an upper end part of the gripping part, wherein the gripping part bends with the lower end part of the gripping part as a fulcrum in the second configuration.

10. The handle described in claim 1, wherein the gripping part has a pair of flange parts.

11. The handle described claim 1, wherein an upper end part of the gripping part has a curved wall part that is curved upwards.

12. The handle described in claim 1, wherein the connecting part comprises an arc shaped inner surface.

13. The handle described in claim 1, wherein the opening becomes narrower from a frontal side towards a backside.

14. The handle described in claim 1, wherein projecting parts that slot into a groove of the bottle have been formed on at least one of the first side plate part and the second side plate part.

* * * * *